United States Patent [19]

Hubers

[11] 4,122,669

[45] Oct. 31, 1978

[54] SINGLE STAGE OR MULTI-STAGE EXPANSION ENGINE

[76] Inventor: Cornelis Hubers, Van Ostadelaan 2, Rozenburg, Netherlands

[21] Appl. No.: 646,419

[22] Filed: Jan. 5, 1976

Related U.S. Application Data

[63] Continuation-in-part of Ser. No. 401,538, Sep. 27, 1973, abandoned, which is a continuation of Ser. No. 193,687, Oct. 29, 1971, abandoned.

[30] Foreign Application Priority Data

Oct. 29, 1970 [NL] Netherlands ..... 7015863

[51] Int. Cl.[2] ..... F02G 1/02

[52] U.S. Cl. ..... 123/200; 60/39.63; 60/39.69 R

[58] Field of Search ..... 60/39.43, 39.6, 39.63, 60/39.69 R, 39.61

[56] References Cited

U.S. PATENT DOCUMENTS

| | | | |
|---|---|---|---|
| 2,977,759 | 4/1961 | Milliken | 60/39.63 |
| 3,227,145 | 1/1966 | Bernard | 60/39.61 |
| 3,577,779 | 5/1971 | Warren | 60/39.69 |
| 3,651,641 | 3/1972 | Sinter | 60/39.6 |
| 3,782,110 | 1/1974 | Kobayashi | 60/39.43 |

FOREIGN PATENT DOCUMENTS

| | | | |
|---|---|---|---|
| 27,970 | 4/1969 | Australia | 60/39.63 |
| 7,015,852 | 5/1972 | Netherlands | 60/39.63 |
| 279,053 | 3/1952 | Switzerland | 60/39.63 |
| 690,805 | 4/1953 | United Kingdom | 60/39.63 |

*Primary Examiner*—Charles J. Myhre
*Assistant Examiner*—Tony M. Argenbright
*Attorney, Agent, or Firm*—Stevens, Davis, Miller & Mosher

[57] ABSTRACT

An expansion engine having a cylinder with a piston and a head provided with a housing in which the housing is subdivided by a partition into a first chamber and a second chamber. The first chamber is in open communication with the cylinder by means of an opening and has at least one burner supported by the partition extending into it. The second chamber communicates with a reservoir for compressed air by way of a conduit and an inlet valve. The reservoir is connected with the cylinder by means of a non-return valve. Both chambers communicate with each other by means of a pressure equalizing conduit which also serves as a heat seal. Air and fuel are supplied to the burner to permit continuous burning.

6 Claims, 3 Drawing Figures

SINGLE STAGE OR MULTI-STAGE EXPANSION ENGINE

Figure 1:
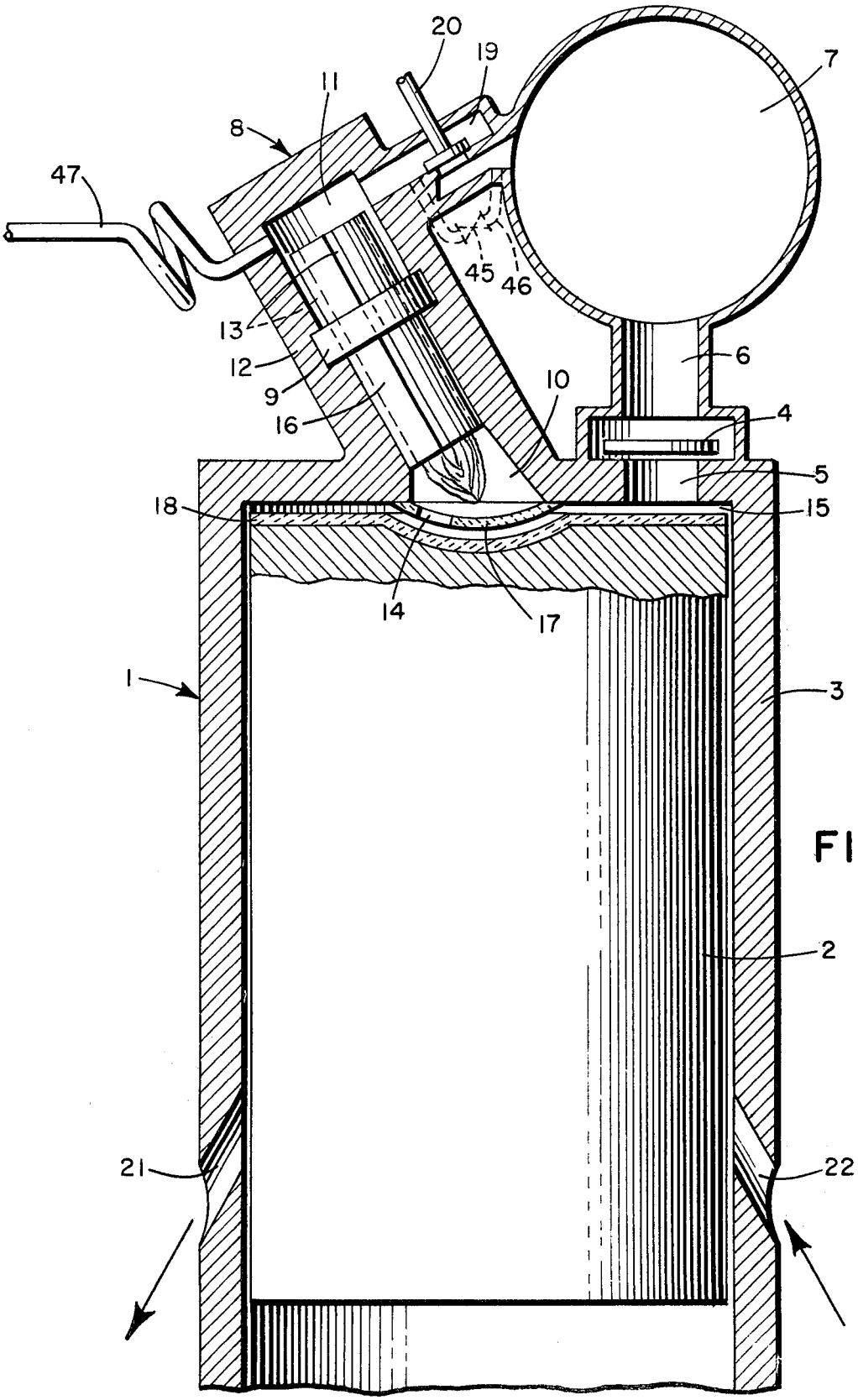

This is a continuation-in-part application of application Ser. No. 401,538, filed Sept. 27, 1973 which in turn is a continuation of application Ser. No. 193,687, filed Oct. 29, 1971, both now abandoned.

This invention relates to a single-stage or multi-stage expansion engine.

The invention aims at providing an expansion engine of large power and a relatively low r.p.m., fed with combustion gases, in which engine *a* substantially complete combustion of the fuel takes place.

This is accomplished with the expansion engine according to the invention in that it comprises a cylinder, a piston within said cylinder, a cylinder cover provided with a construction comprising a burner housing and an air accumulator reservoir, the housing defining a first and a second chamber, a partition dividing the chambers, at least one burner positioned in the partition, the first chamber of the burner housing being in open communication with the cylinder by means of an opening, the second chamber communicating with the air accumulator reservoir, a non-return valve connecting the reservoir to the cylinder at least one pressure equalizing conduit interconnecting the chambers, the conduit being constructed as a seal to prevent combustion gases and combustion air from passing therethrough, means to supply fuel to the burner and means for controlling the quantity of air for furnishing power and for maintaining the flame at a minimum capacity during the remainder of the cycle. The fact that each burner is always supplied with fuel during each driving stroke and with an excess of air which must flow through said burner from the second chamber to the first chamber ensures a complete combustion. A burner of this type is known from Gas and Oil Power, June 1969, pages 134–137.

According to this invention the control means may include a controlled valve to permit a predetermined amount of air to pass from the reservoir to the second chamber and the air passage can be regulated via the valve for maintaining the flame at minimum capacity during the remainder of the cycle with the advantage that the starting moment is less dependent on the motor speed. The controlled valve may be driven in a manner known per se, e.g. by means of a lug provided on an axis driven by the engine or the axis of the engine itself.

Preferably the control means includes a controlled valve within the communication of the reservoir and second chamber, a by-pass around the controlled valve and a control valve in the by-pass, a predetermined quantity of pressurized air filling the second chamber via the controlled valve from the reservoir and dependent thereon, after which the valve closes entirely, and enough air being provided to supply the by-pass to the burner that the flame is maintained also after the closure of the controlled valve. The burner is always kept burning. The fuel and air are fed to the burner. The fuel is not fed to the first chamber and then suddenly fired so that there is no rapid expansion. Since the burner is always kept burning there is no ignition signal. Since the air must pass through the burner it is not possible that the pressure in the first chamber is higher than the pressure in the second chamber. If the pressure in the first chamber would increase less air would be fed to the burner by the first chamber. However, this is not possible as the piston is moved by the pressure of the combustion gases so that there is such an increase in volume that the pressures in the first and second chambers will always be substantially the same. When fresh air out of the cylinder is introduced into the reservoir under the return stroke of the piston the air pressure is greater than the pressure in the reservoir. However, the reservoir is connected by a by-pass to the second chamber. When the pressure in the reservoir increases during the return stroke of the piston the pressure in the second chamber will increase at the same rate. The pressure equalizing conduit is of such a length that no gases will flow therethrough from the first chamber into the second chamber. The piston may include a recess in its upper surface.

According to the invention the expansion engine may be constructed as a single-stage or a multi-stage engine with epicycloidal rotary piston.

The invention will be further explained below with reference to the accompanying drawings showing diagrammatically in part and by way of example three embodiments of the expansion engine according to the invention.

The drawings show in

Figure 2:
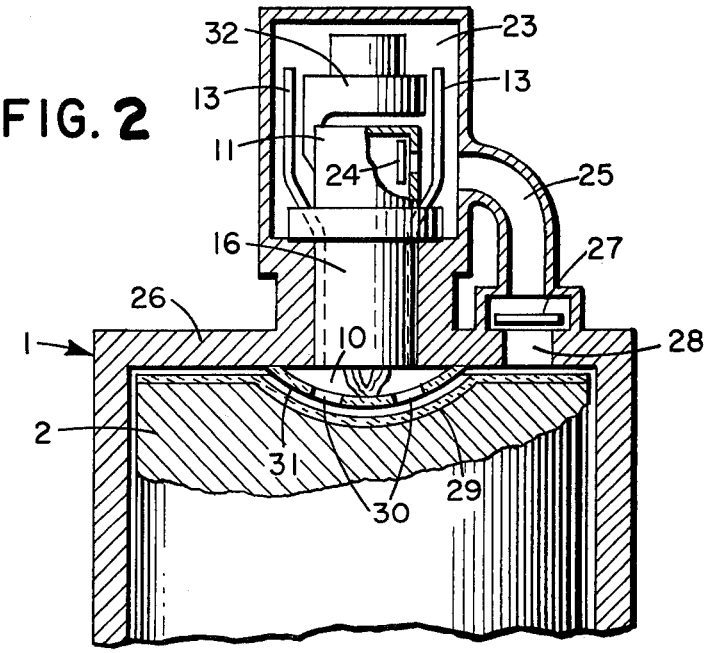
Figure 3:
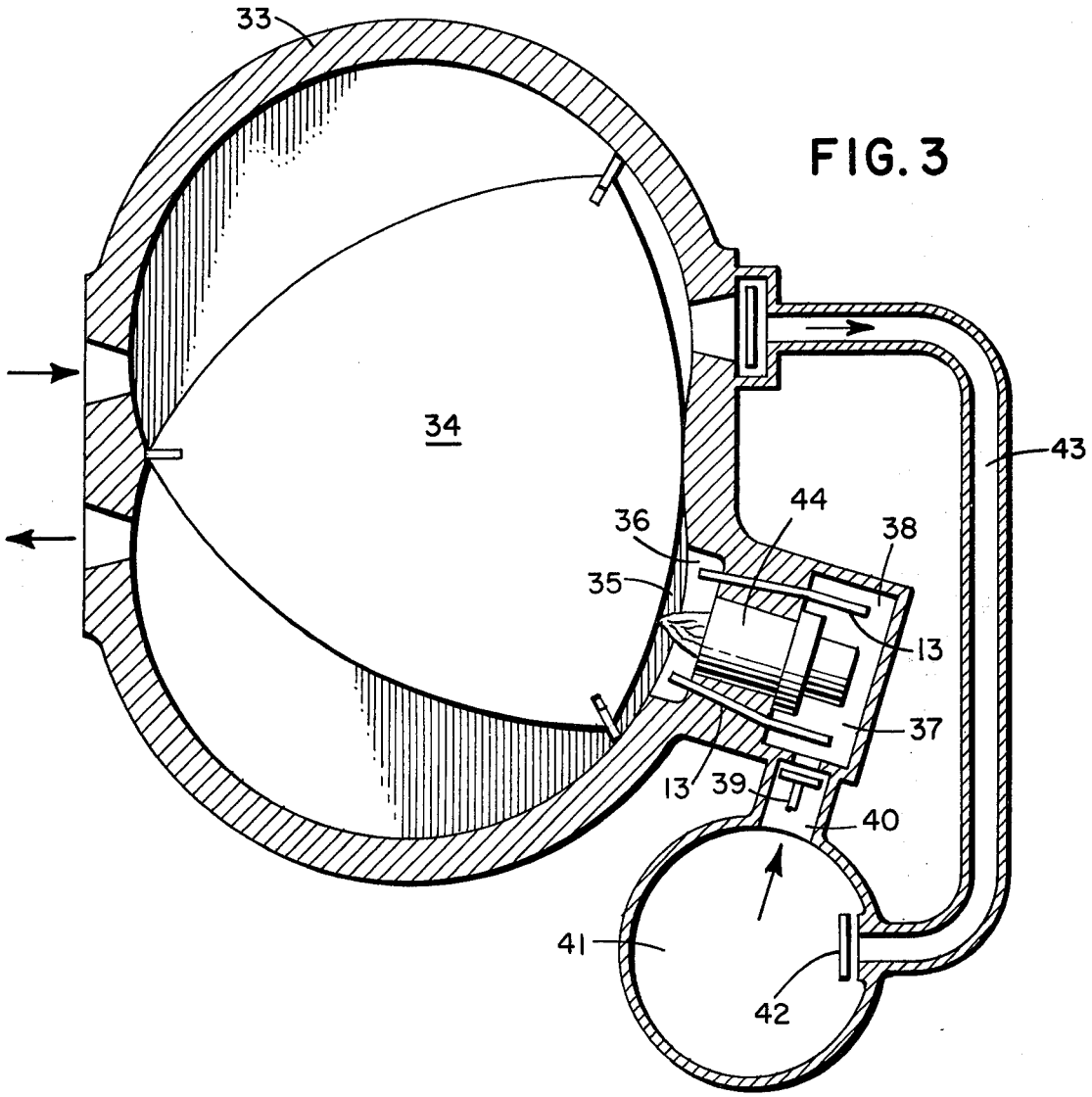

FIG. 1 in section part of the first embodiment comprising a separate reservoir for compressed air;

FIG. 2 in section part of the second embodiment of an expansion engine having a reciprocating piston, the second chamber being provided in the reservoir for compressed air; and FIG. 3 in section part of the third embodiment, the expansion engine having been constructed as a rotary piston engine with an epicycloidal rotary piston.

In FIG. 1 the upper part of a cylinder 1 of an expansion engine is shown, in which a reciprocating piston 2 is provided. In the front wall of the cylinder cover 3 there is provided an opening 5 equipped with a non-return valve 4, the opening being connected by a tube 6 with the reservoir 7 for compressed air.

The upper wall or the cover 3 of the cylinder 1 comprises a housing 8 of a combustion device which in connection with a favorable distribution of space extends according to an angle relative to the cylinder 1 and which is subdivided by a partition 9 into a first chamber 10 and a second chamber 11. The housing is preferably provided with a heat insulating lining 12. The chambers 10 and 11 are in communication with each other by means of conduits 13 serving to equalize the pressure in the chambers and serving also as a heat seal. The conduits may be embodied as grooves in the inner wall of the housing 8 or as tubes arranged in the chambers. As the pressure differences in the two chambers are always very small the conduits will prevent air flowing therethrough from the second chamber into the first chamber or hot gases flowing from the first chamber into the second chamber.

In the chamber 10 which through an opening 14 is in open communication with the cylinder space 15 about the piston 2 there is provided a burner 16 which receives air from chamber 11. A guard plate 17 mounted in the opening 14 prevents the flame of the burner 16 from coming into direct contact with the upper surface of the piston 2. Moreover, the upper surface is provided with a ceramic coating.

The second chamber 11 of the housing 8 is connected with the reservoir 7 by means of a tube 19 comprising a cam-operated inlet valve 20 driven by the expansion engine.

In the conduit 6 valve means 4 is closed when the expansion engine is not in use in order to prevent the compressed air in the reservoir from leaking away. The reservoir 7 is connected with the chamber 11 via a by-pass conduit 46 comprising a valve 45, which is closed when the expansion engine is not in use and which is opened by the operator when starting the engine.

The afore-described expansion operates as follows:

From the reservoir 7 air flows under control of the cam operated inlet valve 20 into the second chamber 11, from where the air flows to the burner 16 to which fuel is supplied via a fuel supply line 47. The combustion gases flow through the opening 14 into the cylinder space 15 pushing the piston downwards until the latter reaches the outlet port or ports 21. The spent combustion gases flow through the outlet ports out of the cylinder and the latter is scavenged via one or more air inlet ports 22 and filled with air, e.g. in the same way as in a two revolution engine. During the return stroke the air above the piston 2 is compressed and passes via non-return valve 4, channel 5 and conduit 6 into the reservoir 7. Part of the air, however, remains in the cylinder between the piston 2 and the cylinder cover 3, as well as in the chamber 10, so that consequently the burner, to which a small amount of fuel is supplied by the fuel supplying system and a small amount of air by the by-pass conduit 46 are supplied, may continue to burn. At the end of the return stroke of the piston the amount of fuel supplied to the burner 16 is increased again.

The embodiment according to FIG. 2 differs from the one according to FIG. 1 in that the upper part of the housing is constituted by having the second chamber 11 coincide with a reservoir 23 for the compressed air, the center line of said reservoir 23 coinciding with the center line of the cylinder 1. The chamber 11 of the burner communicates by means of a cam operated inlet valve 24 biased by a light spring with the reservoir 23, said reservoir being connected by a conduit 25 with an opening 28 comprising a non-return valve 27 and provided in the cylinder cover 26. The contents of the reservoir 23, of the inlet channel of the burner, of the connecting conduit 25 and the space in the cylinder above the piston 2, when the latter is in its highest position, constitute together the volume of one cylinder compression unit. In this instance the non-return valve 27 is provided in order to be able to prevent the air from flowing back without having taken part in the combustion process to a sufficient degree.

In the upper surface of the piston 2 facing the burner 16 a cup-shaped recess 29 is provided, and between said cup-shaped recess 29 and the cylinder cover 26 a guard plate 31 having apertures 30 is mounted which prevents the flame of the burner 16 from coming into direct contact with the upper surface of the piston 2.

In the reservoir 23 there is provided a blower 32 which ensures that also with a minimum supply of fuel sufficient air is supplied to the burner, and as a result the burner may continue to burn during each entire cycle. Just like in the afore-described embodiment the chambers 10 and 11 are in communication with each other through long and narrow channels 13.

FIG. 3 shows a rotary piston engine with a cylinder 33 containing an epicycloidal piston 34. The chamber 35 in the cylinder 33 communicates with a housing 38 comprising two chambers 36, 37, said housing being connected via an opening with a controlled valve 39 and a conduit 40 to a reservoir 41 for compressed air, said reservoir being supplied with fresh air compressed by the piston 34 and fed through a conduit 43 comprising a non-return valve 42. The arrangement comprising the chambers 36 and 37 and the burner 44 may be constructed in the same manner as in the embodiments according to FIGS. 1 and 2.

It is to be noted that if there would not be sufficient air flow, when the piston 34 passes the opening of the chamber 36, to allow the burner to continue to burn, also in this instance a blower can be used.

The arrangement according to the invention may also be constructed as a multi-stage expansion engine in which the combustion gases leaving the first cylinder are successively fed to a cylinder operating at a lower pressure and in a reverse order ultimately the last cylinder supplies compressed air to the reservoir for compressed air.

A multi-stage engine may be constructed such that the first stage of operation is completely used as a filling. In that case no inlet valve 39 is required.

The invention is not restricted to the afore-described embodiments shown in the drawings, but these may be modified in numerous ways without departing from the scope of the claims which are herewith submitted.

What is claimed is:

1. An expansion engine comprising at least one cylinder, a piston within said cylinder, a cylinder cover provided with a construction comprising a burner housing and an air accumulator reservoir, said housing defining a first and a second chamber, a partition dividing said chambers, at least one burner positioned in said partition, the first chamber of the burner housing being in open communication with the cylinder by means of an opening, the second chamber communicating with said air accumulator reservoir, a non-return valve connecting said reservoir to said cylinder, at least one pressure equalizing conduit interconnecting said chambers, said conduit being constructed as a seal to prevent combustion gases and combustion air from passing therethrough, means to supply fuel to the burner and means for controlling the quantity of air for furnishing power and for maintaining the flame at a minimum capacity during the remainder of the cycle.

2. The expansion engine according to claim 1, wherein said control means include a controlled valve to permit a predetermined amount of air to pass from said reservoir to said second chamber and the air passage can be regulated via said valve for maintaining the flame at minimum capacity during the remainder of the cycle with the advantage that the starting moment is less dependent on the motor speed.

3. The expansion engine according to claim 1, wherein said control means includes a controlled valve within the communication of said reservoir and second chamber, a by-pass around said controlled valve and a control valve in said by-pass a predetermined quantity of pressurized air filling the cylinder via the controlled valve from the reservoir and dependent thereon, after which said valve closes entirely and enough air being provided to supply said by-pass to the burner that the flame is maintained also after the closure of said controlled valve.

4. An expansion engine according to claim 1, characterized in that the piston comprises a recess in its upper surface.

5. An expansion engine according to claim 1, characterized in that the piston is constructed as an epicycloidal rotary piston.

6. An expansion engine having at least one cylinder comprising a housing for said cylinder, said housing being subdivided by a partition wall into a first chamber and a second chamber, said first chamber being in open communication with the cylinder, at least one burner equipped with a fuel supply pipe line being provided in said first chamber, a tank for compressed air, a pipe line, a control valve in said pipe line, said pipe line communicating said second chamber with said tank for compressed air, a non-return valve interconnecting said cylinder and said tank, at least one pressure equalizing pipe line which is constructed as a heat seal communicating both chambers with each other, and means to supply a quantity of air for allowing the burner to burn continuously.

* * * * *